US010264905B2

(12) United States Patent
Detweiler

(10) Patent No.: US 10,264,905 B2
(45) Date of Patent: Apr. 23, 2019

(54) COASTER FOR COUPLING TO A CUP

(71) Applicant: Sean D. Detweiler, Concord, MA (US)

(72) Inventor: Sean D. Detweiler, Concord, MA (US)

( * ) Notice: Subject to any disclaimer, the term of this patent is extended or adjusted under 35 U.S.C. 154(b) by 105 days.

(21) Appl. No.: 15/216,434

(22) Filed: Jul. 21, 2016

(65) Prior Publication Data

US 2017/0020319 A1 Jan. 26, 2017

Related U.S. Application Data

(60) Provisional application No. 62/196,561, filed on Jul. 24, 2015.

(51) Int. Cl.
*A47G 23/03* (2006.01)
*A47G 23/02* (2006.01)
(Continued)

(52) U.S. Cl.
CPC ..... *A47G 23/0216* (2013.01); *A47G 23/03* (2013.01); *A47G 23/032* (2013.01);
(Continued)

(58) Field of Classification Search
CPC ..... A47G 23/03; A47G 23/0216; A47G 23/0306; A47G 23/032; B65D 21/0233; B65D 3/06; B65D 57/00; B65D 65/06; B65D 81/3876–81/3886; B65D 85/44; B65D 85/62; B65D 83/005; B65D 5/5035;
(Continued)

(56) References Cited

U.S. PATENT DOCUMENTS 2,071,399 A * 2/1937 Gambell ..... A47G 23/0216 215/394
6,102,352 A * 8/2000 Kvalvog ..... A47G 23/03 248/346.11
(Continued)

FOREIGN PATENT DOCUMENTS

CH 258163 A * 11/1948 ..... B65D 83/005
FR 2878143 A1 * 5/2006 ..... B65D 81/22
WO WO 2004047597 A1 * 6/2004 ..... A24F 19/0028

OTHER PUBLICATIONS

Translation of Charlotte, CH_258163_A_translation.pdf.*

*Primary Examiner* — Anthony Stashick
*Assistant Examiner* — Mollie Impink
(74) *Attorney, Agent, or Firm* — Sean D. Detweiler, Esq.; Morse, Barnes-Brown & Pendleton, P.C.

(57) ABSTRACT

A coaster is structured to be coupled to a conventional cup, such as an iced beverage cup, using a conventional cup sleeve. The coaster includes a generally disk shaped base having an outer perimeter. Two or more elongate tethers extend outwardly from the outer perimeter of the base. The coaster assumes a combination-ready configuration with the two or more elongate tethers extending generally upright and outwardly to a same side of the base, in such a way that the coaster fits snugly within a conventional cup sleeve. In a final combination configuration with a cup sleeve, the coaster combines with the cup sleeve to create an insulating and water absorptive coaster and sleeve, frictionally and snugly coupled to the cup in a robust manner to make the coaster highly portable together with the cup and cup sleeve, and configured to collect condensation formed on the exterior surface of the cup.

19 Claims, 7 Drawing Sheets

(51) Int. Cl.

| | |
|---|---|
| ***A47G 23/032*** | (2006.01) |
| *B65D 83/00* | (2006.01) |
| *B65D 5/50* | (2006.01) |
| *B65D 65/06* | (2006.01) |

(52) U.S. Cl.
CPC ..... *A47G 23/0306* (2013.01); *A47G 23/0316* (2013.01); *B65D 5/5035* (2013.01); *B65D 5/5045* (2013.01); *B65D 65/06* (2013.01); *B65D 83/005* (2013.01)

(58) Field of Classification Search
CPC .... B65D 5/5038; B65D 5/504; B65D 5/5042; B65D 5/5045
USPC ..... 206/496, 514, 761, 804; 215/392–394; 220/738; 229/117.09, 117.22, 117.23, 229/4.5, 400–405, 90; 248/346.11, 346.4, 248/346.5
See application file for complete search history.

(56) References Cited

U.S. PATENT DOCUMENTS

| | | | | |
|---|---|---|---|---|
| 2002/0092274 | A1* | 7/2002 | Banks | B65D 27/22 53/459 |
| 2011/0117353 | A1* | 5/2011 | Henshaw | D02G 3/443 428/221 |
| 2014/0110466 | A1* | 4/2014 | Huang | A47G 19/26 229/404 |
| 2014/0239052 | A1* | 8/2014 | Bugas | B65D 5/563 229/5.81 |

* cited by examiner

COASTER FOR COUPLING TO A CUP

CROSS-REFERENCE TO RELATED APPLICATION

This application claims priority to, and the benefit of, U.S. Provisional Application No. 62/196,561, filed Jul. 24, 2015, for all subject matter common to both applications. The disclosure of said provisional application is hereby incorporated by reference in its entirety.

FIELD OF THE INVENTION

The present invention relates to a coaster able to be coupled to a cup using a conventional cup sleeve in such a way that an entire bottom portion of the cup is covered by the combined components. In particular, the present invention relates to a coaster configured with two or more tethers arranged to slide into a conventional cup sleeve in such a way that a cup placed therein pushes the coaster to a base location, with the tethers stabilizing the coaster and thereby preventing it from flipping as it is pushed through, as well as frictionally anchoring the coaster in place coupled with the cup. The resulting coaster and sleeve form a water absorbing structure suitable for capturing condensation formed on an exterior surface of the cup placed therein.

BACKGROUND

Generally, in the food service industry, service providers provide disposable accessories that compliment and improve the customer experience with the food service products. One such disposable accessory is known as the conventional cup sleeve or the cup holder sleeve, for example as disclosed in U.S. Pat. No. 5,425,497. The general purpose of this cup sleeve is to insulate the user's hands from the walls of the cup containing hot or cold liquids, and in some instances improve gripability of the cup. Most often, such cup sleeves are used for cups containing hot coffee, and cup sleeves are readily available at food service provider locations, or other locations providing hot coffee and/or tea beverages for consumption.

However, while the cup sleeve is generally sized, dimensioned, and configured with a structure that fits on cold beverage containers in addition to hot beverage containers, the cup sleeve experiences some shortcomings when used with a cold or ice-filled beverage. Specifically, cold liquid within a container placed in an environment having humidity very often causes moisture from the surrounding environment to condense on the exterior surface of the container and run down that surface to the table upon which the cup sits. If a cup sleeve is utilized, the cup sleeve may capture some of the condensation, but the entire base of the container remains exposed for condensation to form and make contact with the table or other surface upon which the cup is placed. As such, it is clear from the ordinary observer that consumers of cold beverages, such as iced coffee, do not tend to use cup sleeves to capture condensation. Rather, two alternate solutions are generally implemented. A first solution is to wrap a napkin, or paper towel, around the cold beverage container. The napkin absorbs the condensation, but over time becomes saturated with water and easily torn, and does not affix to the cold beverage container in any reliable manner (the napkin, once wetted, clings to the cup, but can always be easily moved, fall off, torn away, or the like). The napkin, and even layers of napkin, have insufficient structure to absorb water and not degrade, decompose, break apart, or become so fragile as to succumb to the tearing described. A second solution commonly utilized is to place the plastic cold beverage container inside a larger polystyrene or other container (i.e., place an entire cup within a second cup of the same configuration). While this solution does insulate the cold beverage, and capture the condensation on the sides and base of the beverage container, the solution is wasteful in that it requires use of two cups where the material in the upper half or more of the second cup is excessive and has no purpose. Furthermore, when the second cup is a polystyrene container, such containers are banned in certain geographic locations for their lack of recyclability, making the need for an alternative solution even greater.

Approaching the problem of condensation on cold beverage containers from a different perspective, the well-known accessory for use with such cold beverage containers to capture the condensation is a coaster. However, coasters do not generally couple with the cold beverage container, thus making it difficult for portability together with the cold beverage. For example, a consumer of an iced coffee would need to separately transport a coaster and place it down on a table or other surface before placing the cold beverage container down on top of the coaster. If the beverage consumer then wants to move to another location, they need to pick up and transport both the coaster, and the cold beverage container, separately. Furthermore, the conventional coaster does not fit in cup holders, such as those found in most automobiles. Several inventors over the years have attempted to address this problem by creating numerous different coasters that attempt to couple with the cold beverage container. For example, see U.S. Pat. Nos. 2,608,074, 2,727,645, 3,598,271, 4,759,525, and 5,018,695. However, in all instances, the coasters require the container to have special coupling features, or the coasters create a larger structure that is more cumbersome than the original beverage container itself, and wherein the coasters are easily knocked-off or decoupled from the beverage container, making portability and convenience an issue.

The combination beverage sleeve and coaster disclosed in U.S. Pat. No. 6,026,983 is an attempt at addressing many of the above shortcomings. However, with this configuration, the combination cup sleeve and coaster requires a hexagonal shaped base and hexagonal shaped cross-sectional area. Virtually all beverage containers (and certainly the most conventional iced coffee cups) have a circular base and a circular cross-sectional area. Thus, the hexagonal shape inherently creates a substantially larger structure than the original beverage container, and the structure has gaps at each corner of the hexagonal wall, making it difficult to grip the cup holder sleeve portion without pushing the sleeve off of the beverage container and loosening the coupling fit between the sleeve and the container. Furthermore, another gap is required between the hexagonal base and the wall of the hexagonal cup sleeve, where condensation running down through the gaps of the hexagonal corners can leak out from the base through the gap between the base and the sleeve. As such, the effectiveness of the combination cup sleeve and coaster in the '983 patent to absorb condensation and prevent leakage out is substantially reduced or essentially nonexistent. Likewise, the portability of the beverage container with the cup sleeve is hindered because of the various gaps that allow the container to move around within the sleeve, and because of the non-compatible nature of the hexagonal shape with common cup holders (e.g., in automobiles), making it virtually impossible to place a beverage container with this hexagonal sleeve into a conventional cup holder.

SUMMARY

There is a need for a coaster that can effectively capture condensation that forms on conventional, widely utilized, cold beverage containers, as well as be highly portable by coupling to the beverage container in a robust manner such that the coaster is not easily knocked-off of the beverage container, all while also maintaining the ability of the cold beverage container to fit within conventional cup holder structures, being preferably formed of an inexpensive, biodegradable, and recyclable material, and not requiring the excess material that the use of a second cup placed in a first cup requires. The present invention is directed toward further solutions to address this need, in addition to having other desirable characteristics.

Specifically, in accordance with an illustrative embodiment of the present invention, a coaster for use in combination with a cup sleeve includes a generally disk shaped base having an outer perimeter and two or more elongate tethers extending outwardly from the outer perimeter of the base. The coaster assumes a combination-ready configuration with the two or more elongate tethers arranged in an angled configuration relative to the base, each of the two or more elongate tethers extending generally upright and outwardly to a same side of the base.

In accordance with aspects of the present invention, the coaster further includes a raised edge disposed along the outer perimeter of the base, the raised edge having a height that is less than a length dimension of the two or more elongate tethers. The raised edge disposed along the outer perimeter of the base can be formed of a plurality of tabs angled upright from the base along the outer perimeter to form the raised edge. The raised edge can include an annular wall extending upright from the base along the outer perimeter to form the raised edge.

In accordance with aspects of the present invention, when the coaster is in the combination-ready configuration, the base and the two or more elongate tethers have a structure sized, dimensioned, and configured to snugly fit and frictionally mount within the cup sleeve when the base is oriented generally planar with a generally circular cross-sectional opening of the cup sleeve when in a fully expanded configuration and the opening of the cup sleeve is expanded to receive a generally cylindrical or frusto-conical cup therethrough. The base of the coaster can be configured to receive a base of the generally cylindrical or frusto-conical cup as it is placed through the cross-sectional opening of the cup sleeve. The structure of the two or more elongate tethers can be sized, dimensioned, and configured to frictionally drag against the cup sleeve and stabilize the base of the coaster as the coaster is pushed through toward a bottom open end of the cup sleeve by the base of the generally cylindrical or frusto-conical cup as it is placed through the cross-sectional opening of the cup sleeve.

In accordance with aspects of the present invention, the coaster is in a final combination configuration with the cup sleeve when the coaster occupies and is oriented generally planar with a generally circular cross-sectional opening of the cup sleeve when the cup sleeve is in a fully expanded configuration, in such a way that the opening of the cup sleeve is configured to receive a generally cylindrical or frusto-conical cup therethrough. The structure of the two or more elongate tethers can be sized, dimensioned, and configured having a thickness dimension enabling compression of the two or more elongate tethers between the cup sleeve and a generally cylindrical or frusto-conical cup placed therein, the two or more elongate tethers frictionally holding the base in place to cover an open end of the cup sleeve.

In accordance with aspects of the present invention, the coaster can be formed of a moisture absorbent material. The coaster can be formed of a material that is biodegradable, compostable, or both. A water-impermeable coating material can be disposed to form a layer on an exterior side of the base. The water-impermeable coating material can be biodegradable. The coaster can be biodegradable and recyclable.

In accordance with aspects of the present invention, the coaster can further include indicia disposed thereon. The coaster can have three elongate tethers. The coaster can have four elongate tethers.

In accordance with the above summary, the coaster can be configured to include the above features in any operable configuration.

In accordance with an example embodiment of the present invention, a moisture absorbent coaster can include a generally disk shaped body including a generally planar surface, and further comprising at least one layer of at least partially absorbent material. Two or more elongate tethers can extend from the body and be positionable in a generally orthogonal direction in relation to the generally planar surface of the body. The outer perimeter of the body, not including the two or more elongate tethers, can be of a generally geometric shape, and the two or more elongate tethers can extend beyond and external to that generally geometric shaped outer perimeter of the body. The body can have a structure sized, dimensioned, and configured to be pushed through a cross-sectional area of a sleeve that is configured to frictionally fit around a beverage container, the body being pushed by the beverage container as it is inserted through the sleeve. Upon the body being pushed through the cross-sectional area of the sleeve, the two or more elongate tethers can fold in the generally orthogonal direction to the body and be frictionally wedged between the beverage container and the sleeve, frictionally holding the coaster in place coupled with the beverage container and the sleeve. In accordance with aspects of the present invention, the coaster can further include plurality of tabs disposed along an outer perimeter of the body, each of the plurality of tabs positionable in a generally orthogonal direction relative to the generally planar surface of the body. The plurality of tabs can fold in the generally orthogonal direction to the body in such a way that the plurality of tabs form a raised edge along the outer perimeter of the body when the coaster is combined with the sleeve.

BRIEF DESCRIPTION OF THE FIGURES

These and other characteristics of the present invention will be more fully understood by reference to the following detailed description in conjunction with the attached drawings, in which.

Figure 1:
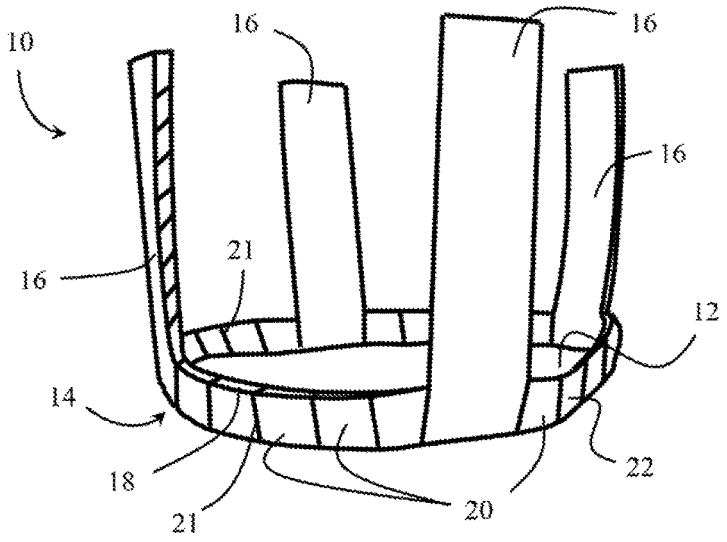
FIG. 1 is a perspective side view of a coaster, in accordance with the present invention.
Figure 4A:
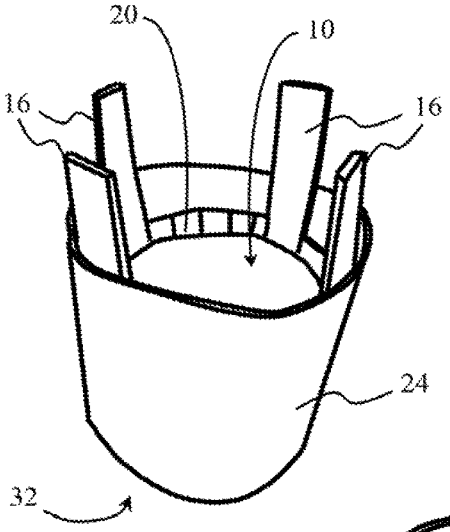
FIGS. 4A, 4B, and 4C together form a stepwise illustration of the coaster of FIG. 1 placed within a cup sleeve (FIG. 4A), a cup placed into the coaster and cup sleeve (FIG. 4B)
Figure 4B:
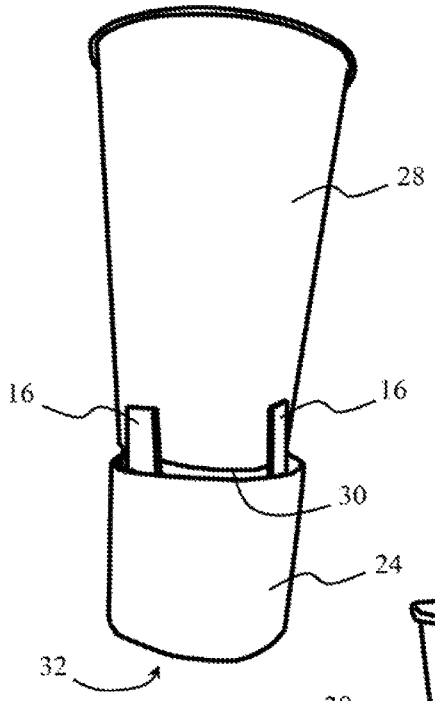
Figure 4C:
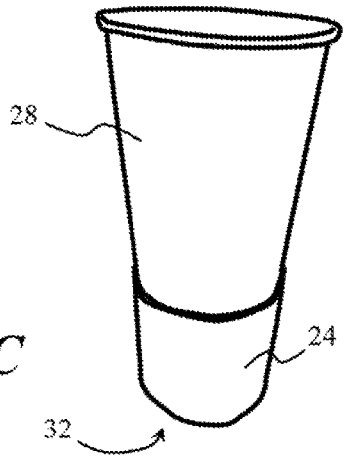
Figure 4D:
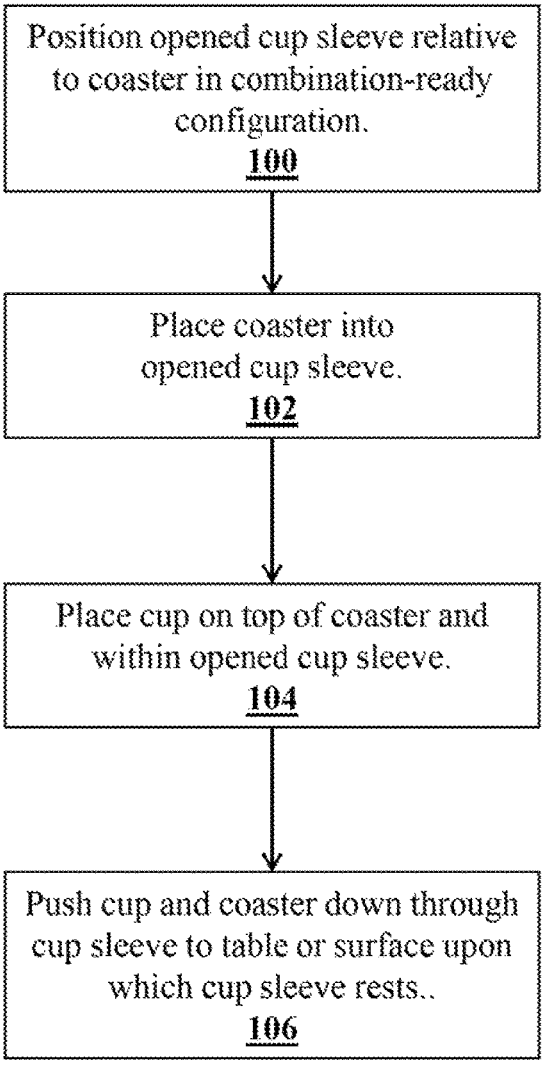
Figure 5:
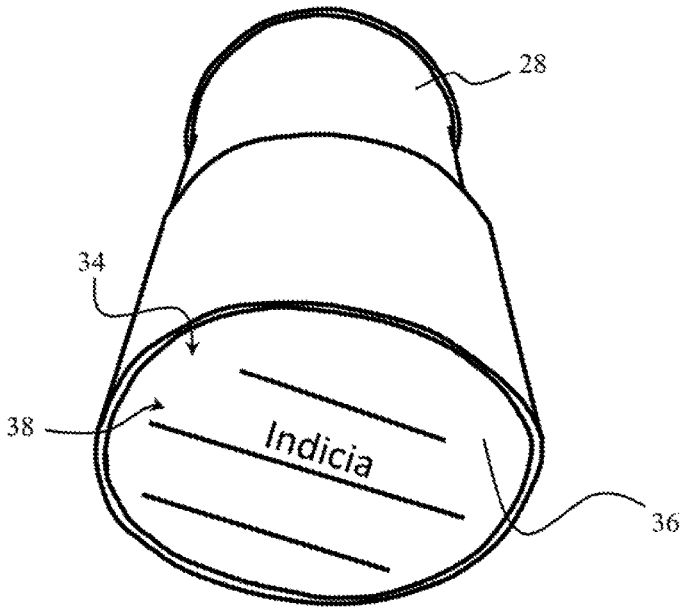
Figure 6:
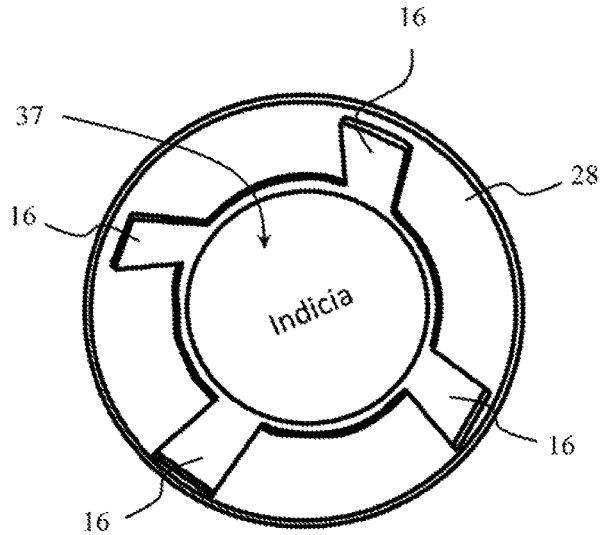
Figure 7A:
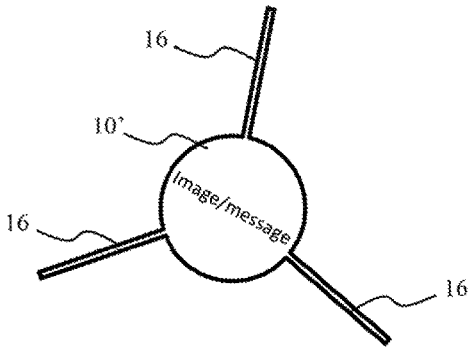
Figure 7B:
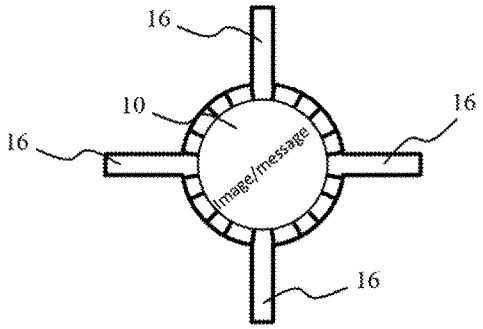
Figure 7C:
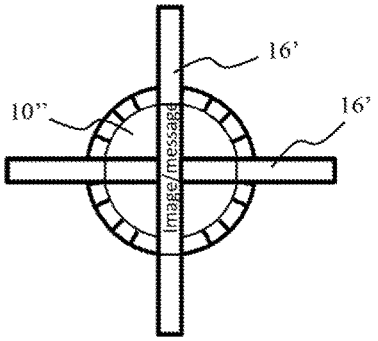
Figure 7D:
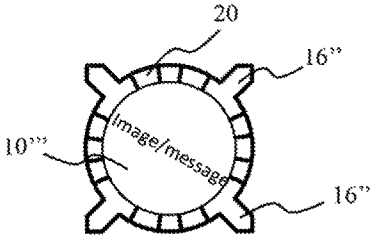
Figure 7E:
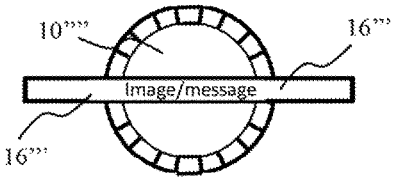
Figure 8A:
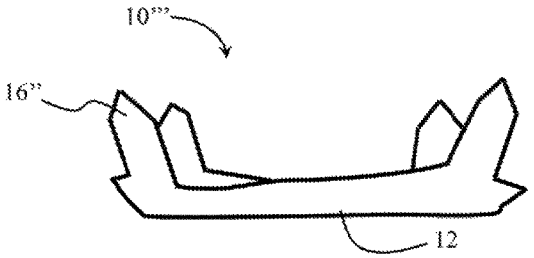
Figure 8B:
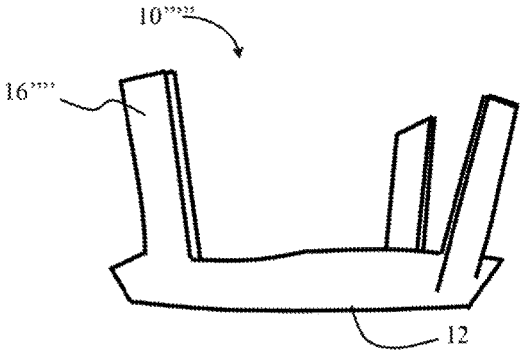
Figure 8C:
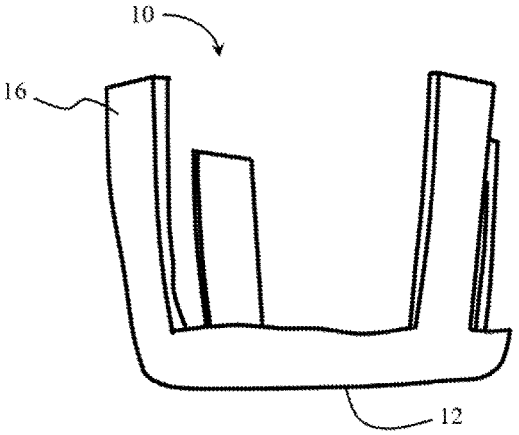

and the cup pushed down through the cup sleeve until the coaster slides down to a base position and is frictionally held within the cup sleeve (FIG. 4C);

FIG. 4D is a flowchart depicting the stepwise process shown in FIGS. 4A, 4B, and 4C;

FIG. 5 is a bottom perspective view of the coaster of FIG. 1 in combination with a cup sleeve, with the combination of the coaster and cup sleeve positioned and frictionally held onto a cup;

FIG. 6 is a top perspective view of the coaster of FIG. 1 in combination with a cup sleeve, with the coaster disposed and frictionally held within the cup sleeve;

FIGS. 7A, 7B, 7C, 7D, and 7E are diagrammatic illustrations of the coaster of the present invention in various different configurations, and with different quantities and sizes of tethers coupled thereto; and FIGS. 8A, 8B, and 8C, are perspective side views of the coaster of the present invention, each view having tethers of different configuration and dimension, thereby demonstrating tethers of different length.

DETAILED DESCRIPTION

The present invention answers the question, how does one capture condensation on the outside of a conventional cup, such as an iced coffee cup, without requiring use of a second cup, and with a structure that does not inconveniently tear and fall apart when it gets wet, and that will stay robustly coupled to the conventional cup so that it can be easily transported with the cup and fit within conventional cup holders and the like without undue fumbling? An illustrative embodiment of the present invention relates to a coaster that is able to be coupled to a cup using a conventional cup sleeve. The coaster includes a generally disk shaped base having an outer perimeter. Two or more elongate tethers are disposed on the base and extend outwardly from the outer perimeter of the base. The coaster assumes a combination-ready configuration with the two or more elongate tethers extending generally upright and outwardly (i.e., in a generally orthogonal direction) to a same side of the base. In this combination-ready configuration, the coaster fits snugly within a conventional cup sleeve structure sized, dimensioned, and configured for widely used conventional disposable iced coffee cups. The base when combined with the cup sleeve is oriented generally planar with, and across, a generally circular cross-sectional opening of the cup sleeve when in a fully expanded configuration (i.e., generally parallel with the bottom of the cup), the opening of the cup sleeve being configured to receive a generally cylindrical or frusto-conical cup therethrough. The coaster can include a raised edge disposed along the outer perimeter of the base, the raised edge having an annular wall extending upright from the base along the outer perimeter to form the raised edge. The two or more elongate tethers are sized, dimensioned, and configured with a structure that frictionally drags against the cup sleeve and stabilizes the base of the coaster such that it doesn't flip as the coaster is pushed through toward a bottom opening of the cup sleeve by the base of the generally cylindrical or frusto-conical cup as it is placed through the cross-sectional opening of the cup sleeve. In a final combination configuration with a cup sleeve when the coaster occupies and is oriented generally planar with a generally circular cross-sectional opening of the cup sleeve (i.e., generally parallel to the bottom of the cup), the coaster is frictionally held between the cup and the cup sleeve by the two or more elongate tethers, as well as the raised edge (when the embodiment includes such edge). In this final configuration, the coaster combines with the cup sleeve to create an insulating and water absorptive coaster and sleeve, frictionally and snugly held onto, i.e., coupled to, the cup in a robust manner to make the coaster highly portable together with the cup and cup sleeve, and configured to collect condensation formed on the exterior surface of the cup, without any gaps allowing leakage of condensation therethrough. The coaster of the present invention, working in conjunction with a conventional cup sleeve, solves the shortcomings of the known art.

FIGS. 1 through 8C, wherein like parts are designated by like reference numerals throughout, illustrate an example embodiment or embodiments of a coaster for use in combination with a conventional cup sleeve, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 2:
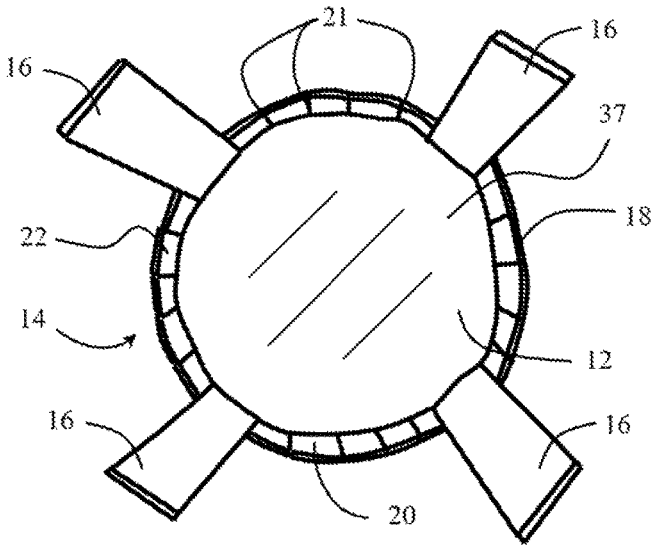
FIG. 2 is a perspective top view of the coaster of FIG. 1.
Figure 3:
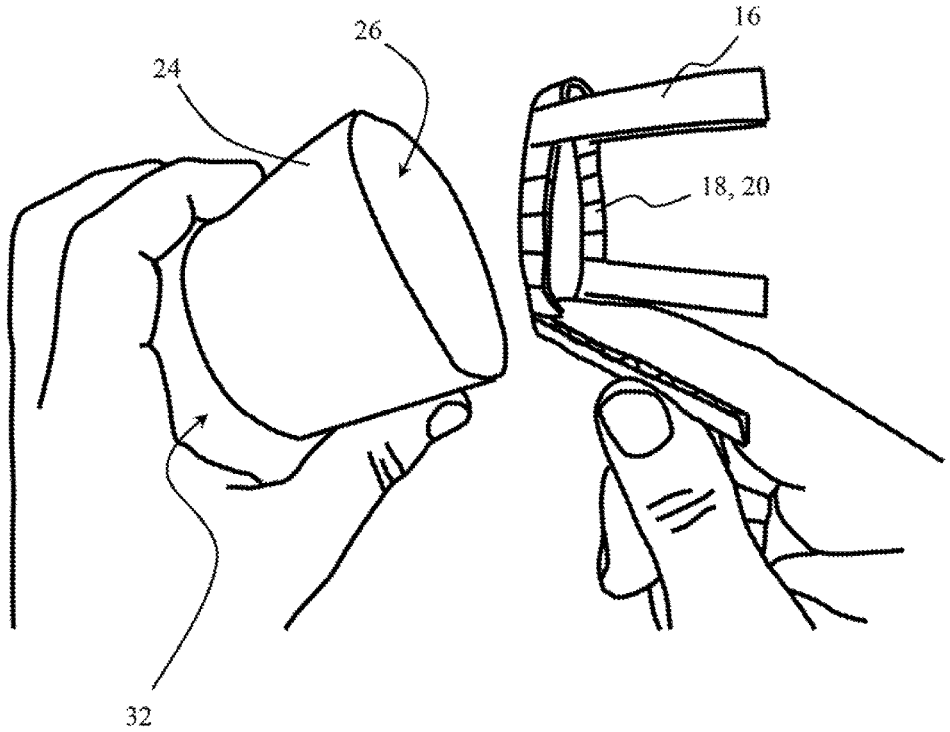
FIG. 3 is a diagrammatic illustration of a user placing the coaster of FIG. 1 in combination-ready form into a cup sleeve in an open configuration.

FIG. 1 is a perspective view of a coaster 10 for use in combination with a conventional cup sleeve 24 (see FIG. 3, et al.). The coaster 10 includes a generally disk shaped base 12 having an outer perimeter 14. In that the base 12 is generally disk shaped, it maintains a generally flat, thin, round shape, the flat portion having a generally planar surface. Two or more elongate tethers 16 are disposed on the base 12 and extend outwardly from the outer perimeter 14. The coaster 10 assumes a combination-ready configuration, as shown in FIGS. 1 to 3, with the two or more elongate tethers 16 arranged in an angled, folded or similar configuration, each of the two or more elongate tethers 16 extending generally upright and outwardly (such as in a generally orthogonal direction) to a same side of the base 12.

For purposes of clarity, in accordance with an embodiment of the present invention, the coaster 10 of the present invention is sized, dimensioned, and configured with a structure operable in the manner described herein together with a conventional cup sleeve 24, as in the conventional cup sleeve used around the world to fit on conventional disposable coffee cups to protect the user's hands from the heat of the beverage contained therein. The term "conventional" when referring to the conventional cup sleeve 24 is intended to mean with regard to size, dimension, and configuration, as would be readily ascertained and understood by those of skill in the art. The conventional cup sleeve 24 was originally described in U.S. Pat. No. 5,425,497, which is incorporated herein by reference in its entirety for purposes providing enabling details of an illustrative conventional cup sleeve. There have been variations to that sleeve, all of which are utilized in the same general manner and which are considered for purposes of the present application to fall within the meaning and scope of the phrase "conventional cup sleeve" or "cup sleeve" as utilized interchangeably throughout the present application. The coaster 10 works in conjunction with the conventional cup sleeve 24. It should be noted that any other previously designed prior art coasters or other devices that may have a similar looking configuration in terms of a base and tethers but that are not sized, dimensioned, and configured structurally to operate in the manner described herein with a conventional cup sleeve 24 are different from the present invention and do not anticipate or make obvious the structure or features of the present coaster 10 invention at least because they cannot be utilized in conjunction with the conventional cup sleeve 24 to couple the coaster 10 to a cup in the manner the present coaster 10 can be utilized and be operable as described and depicted herein, nor was such a concept in the possession of the inventors of such other similarly allegedly similarly structured devices. The Applicant at the time of the filing of the present application is aware of no other device or structure that has been designed and configured in the manner described herein to achieve the benefits, features, utility, and operability, with the specific purpose of being used in combination with conventional cup sleeves, as is embodied by the present claimed invention.

Turning back to the description of the present invention, in accordance with an example embodiment, the coaster 10 further includes a raised edge 18 disposed along the outer perimeter 14 of the base 12. In accordance with one embodiment of the present invention, the raised edge 18 is formed of a plurality of tabs 20 angled or folded upright from the base 12 along the outer perimeter 14 to form the raised edge 18. In accordance with an alternative embodiment, the raised edge 18 includes an annular wall 22 extending upright from the base 12 along the outer perimeter 14 (see FIG. 1). The raised edge 18, if formed of the plurality of tabs 20, can be formed by cutting or shaping the base 12 having a plurality of slits 21 to form the plurality of tabs 20, and then folding up the plurality of tabs 20 to form the raised edge 18, either manually or using a machine. Likewise, the annular wall 22 can be formed by press-fit or other pressure applied process to bend up and form the raised edge 18, as would be understood by those of skill in the art of cardboard manufacture and shaping. Other procedures and manufacturing techniques readily apparent to those of skill in the art are likewise anticipated by the present invention and description, and are intended to fall within the scope of the present invention, as would be appreciated by those of skill in the art, such that the present invention is by no means limited to the processes and mechanisms described herein to form the described raised edge 18 structure.

When the coaster 10 is in the combination-ready configuration, the base 12 and the two or more elongate tethers 16 have a structure sized, dimensioned, and configured to snugly fit and frictionally mount within the cup sleeve 24 (i.e., the conventional cup sleeve), thereby removably coupling the coaster 10 to the cup. The base 12, when mounted in the cup sleeve 24, is oriented generally planar with a generally circular cross-sectional opening 26 (see FIG. 3) of the cup sleeve 24 when in a fully expanded configuration, such as when the cross-sectional opening 26 of the cup sleeve 24 is configured to receive a generally cylindrical or frusto-conical cup 28 therethrough. The generally cylindrical or frusto-conical cup 28, for the purposes of the present description, is considered to have a structure sized, dimensioned, and configured in the form equivalent to and including a conventional disposable coffee cup or iced coffee cup, as is widely known and utilized, and as would be readily appreciated by those of skill in the art in view of the present description.

The base 12 of the coaster 10 is configured to receive a base 30 of the generally cylindrical or frusto-conical cup 28 as it is placed through the cross-sectional opening 26 of the cup sleeve 24 (see FIGS. 4A and 4B).

The two or more elongate tethers 16 are sized, dimensioned, and configured with a structure that frictionally drags against the cup sleeve 24 and stabilizes the base 12 of the coaster 10 as the coaster 10 is pushed through toward a bottom open end 32 of the cup sleeve 24 by the base 30 of the generally cylindrical or frusto-conical cup 28 as it is placed through the cross-sectional opening 26 of the cup sleeve 24.

The coaster 10 is in a final combination configuration with the cup sleeve 24 when the coaster 10 occupies and is oriented generally planar with the cross-sectional opening 26 of the cup sleeve 24 when the cup sleeve 24 is in a fully expanded configuration, such that the opening of the cup sleeve 24 is configured to receive the generally cylindrical or frusto-conical cup 28 therethrough.

The two or more elongate tethers 16 are sized, dimensioned, and configured with a structure having a thickness dimension enabling compression of the two or more elongate tethers 16 between cup sleeve 24 and a generally cylindrical or frusto-conical cup 28 placed therein, the two or more elongate tethers 16 frictionally holding the base 12 in place to cover the bottom open end 32 of the cup sleeve 24. This thickness dimension, prior to compression, is generally about 2 mm (about 0.07874 in.) in accordance with example measurements of example embodiments, but can range between about 0.5 mm (about 0.01969 in.) to about 3 mm (about 0.1181 in.) in most common applications of the present invention with the conventional cup sleeve 24 and conventional coffee cup or iced coffee cup. The final determination of the most preferred thickness dimension is ultimately determined by the internal diameter measurement of the particular cup sleeve 24 and the outer diameter measurement of the particular cylindrical or frusto-conical cup 28, which when combined form a gap therebetween. The gap is then filled by the thickness dimension of the elongate tethers 16 in such a way that when the coaster 10, the cup sleeve 24, and the cylindrical or frusto-conical cup 28 are combined as described herein, the elongate tethers 16 have a thickness dimension that results in the tethers being sandwiched between the cup sleeve 24 and the cylindrical or frusto-conical cup 28 and compressed to establish the frictional coupling described herein, sufficient to frictionally hold the elongate tethers 16 and coaster 10 in place. If the thickness dimension in a particular combination is too small (i.e., too thin) then the two or more elongate tethers 16 will too easily slip out from between the cup sleeve 24 and the cylindrical or frusto-conical cup 28 during normal use. If the thickness dimension in a particular combination is too large (i.e., too thick) then the two or more elongate tethers 16 will prevent the cylindrical or frusto-conical cup 28 from being able to fit snugly within the combined coaster 10 and cup sleeve 24 at all without damaging the frusto-conical cup 28 or the cup sleeve 24. Those of skill in the art will readily appreciate these telltale signs described above, and be able to determine the preferred thickness dimension of a particular set of two or more tethers of a coaster 10 and cup sleeve 24 combination. Those of skill in the art will further appreciate that most cardboard materials that are commonly utilized in today's conventional cup sleeves 24 are of the appropriate size, dimension, and configuration that if they are also utilized to form the coaster 10 they will be appropriate to enable the combinations and operational aspects of the coaster 10 as described herein, such that any variation to the dimensions and function described herein would be readily determined based on the teaching of the present disclosure, and therefore such variations are considered anticipated by the present invention. Also of note, the present coaster 10 was engineered with a structure that is intended to be suitable for use with the conventional cup sleeves 24 and the conventional cold beverage plastic cups (such as those commonly used for iced coffee) as the frusto-conical cup 28 referred to throughout the present description.

In accordance with an example embodiment of the present invention, the coaster 10 is composed of a moisture absorbent material. Such material can include, but not be limited to, most cardboard and corrugated materials utilized in conventional cup sleeves 24. In accordance with aspects of the present invention, the cardboard and corrugated materials can include any other cellulose-based material, or any other suitable water-permeable, biodegradable, and compostable material. For example, the wall can be formed of a water-permeable, biodegradable, and compostable material comprising cellulose, starch (e.g., corn, potato, tapioca, etc.), soy protein, lactic acid, or the like. For purposes of the present description, a coaster 10 built using substantially cellulose material (e.g., paper, cardboard, etc.) is described.

Likewise, variations on such cardboard and corrugated materials to increase absorptivity are also considered to be of use as a material to form the coaster 10 in accordance with the present invention. The coaster 10 material can likewise be biodegradable, compostable, or both, and can further include a water-impermeable coating material disposed to form a layer 36 on a bottom or exterior side 34 (that is the side opposite the side facing the generally cylindrical or frusto-conical cup 28, such as an interior side 37)) of the base 12. The water-impermeable coating can itself be biodegradable, making the coaster 10 biodegradable and recyclable.

More specifically, the biodegradable, water-impermeable coating forming a layer 36 across a bottom side of the coaster 10 (such as the exterior side 34) can improve the ability of the coaster 10 to absorb condensation and prevent it from leaking completely through the coaster 10 and out the bottom or exterior side 34 to the table or surface upon which the coaster 10 rests. Accordingly, in this way, exterior side 34 can be rendered water-impermeable, such that fluid contents are prevented from escaping completely through the coaster 10 over time (wherein the time period considered relevant is the time that a beverage typically remains in a cup while being consumed, i.e., from a few minutes up to at least several hours, or even a day). Furthermore, despite the water-impermeability of the layer 36 on the exterior side 34, the coaster 10 as a whole is biodegradable and compostable through the use of bioplastic material to form the layer 36.

The present description makes reference to the use of bioplastics as well as various properties, including biodegradability and compostability. As would be appreciated by one of skill in the art, bioplastics can be derived from renewable raw materials including starch (e.g. corn, potato, tapioca, etc.), cellulose, soybean protein, lactic acid, and the like. Such materials are not typically hazardous or toxic in production and are capable if decomposition into materials such as carbon dioxide, water, and biomass when composted. Bioplastics generally can take different lengths of time to completely and fully compost, depending on the particular material. Bioplastics conventionally are intended to be composted in an industrial or commercial composting facility that is able to generate high composting temperatures for extended periods (e.g., between about 90-180 days in some instances).

The term "compostable" is intended to have its normal meaning, as would be appreciated by one of skill in the art upon reading the present specification. For example, according to the American Society for Testing & Materials (ASTM), a bioplastic is compostable if it is capable of undergoing biological decomposition in a compost site as part of an available program, such that the plastic is not visually distinguishable and breaks down into carbon dioxide, water, inorganic compounds, and biomass, at a rate consistent with known compostable materials (e.g., cellulose) and if through the process of biological decomposition the bioplastic leaves no toxic residue. Furthermore, most existing international standards define "compostable" to include those materials capable of biodegradation of about 60% within about 180 days (e.g., in combination with other criteria). In general, it will be appreciated upon reading the present specification that for a bioplastic to be compostable, three criteria must be met: the bioplastic must be: (a) capable of biodegradation, e.g., the break-down into carbon dioxide, water, biomass at the same rate as cellulose or paper; (b) capable of disintegration, e.g., the material must be capable of becoming indistinguishable within the compost, such that it is not visible and need not be screened out; and (c) non-eco-toxic, e.g., must not produce any toxic material, such that the resulting compost can support plant growth. The amount of time required to compost can change depending on a variety of factors. Commercial composting facilities tend to grind materials being composted and agitate (e.g., stir, turn over, etc.) the resulting piles while exposing the piles to high temperatures. This reduces the amount of time required for the materials to compost. However, composting rates at home composts can be significantly lower and can vary depending on how frequently the pile is agitated (e.g., stirred, turned over, etc.), the moisture of the pile, the contents of the materials forming the pile, the temperature of the pile, and other environmental conditions.

To be "biodegradable," a bioplastic must be capable of degrading as a result of naturally occurring microorganism (s), such as bacteria, fungi, and the like. However, unlike compostability, the quality of not leaving behind a toxic residue is not a requirement for biodegradability.

Accordingly, the terms "biodegradability" and "compostability" generally are intended to have their normal meanings and definitions, as would be appreciated by one of skill in the art upon reading the present specification.

The biodegradable, water-impermeable layer 36 in combination with the cardboard material of the coaster 10 creates a barrier that prevents water (or other liquid contents) absorbed by the coaster 10 from making direct physical contact with the exterior side 34 (e.g., the bottom outward facing side) of the coaster 10 as depicted. This can be beneficial, for example, in preventing condensation absorbed by the coaster 10 from eventually soaking through the base 12 and reaching the table or other surface upon which the coaster 10 rests. In general, the biodegradable, water-impermeable layer 36 can be biodegradable in one or more first environmental conditions, such as standard biodegradation conditions or composting conditions, as would be appreciated by one of skill in the art. In an illustrative embodiment, the biodegradable, water-impermeable layer 36 is made of polylactic acid (PLA). Alternatively, any other suitable biodegradable, water-impermeable coating materials can be utilized with the present invention.

In accordance with an example embodiment of the present invention, the coaster 10 can further include one or more indicia 38 (i.e., in the form of an image, message, or other written indication) disposed thereon, as depicted in FIG. 5 and FIG. 6, optionally. The indicia 38 can contain information, an advertisement, an image (including a logo or trademark), or the like, which can be placed to be viewable by a user placing the coaster 10 in the cup sleeve 24 or underneath the coaster 10 when combined with the cup sleeve 24

(as in FIG. 5). The benefits of such indicia 38 are readily apparent to those of skill in the art.)

In accordance with example embodiments of the present invention, the coaster 10 can have a number of different configurations that meet the basic requirements of structure described herein. FIGS. 7A through 7E show illustrative examples of these different configurations with the coaster 10 in a flattened configuration, prior to having the elongate tethers 16 and plurality of tabs 20 or annular walls 22 folded in the generally orthogonal direction from the coaster 10 to achieve the combination-ready configuration. For example, FIG. 7A shows a coaster 10' with three elongate tethers 16 instead of four, and the three elongate tethers 16 of this illustration are shown as substantially longer and thinner than those of FIGS. 1 and 2. FIG. 7B shows the coaster 10, which is representative of the configuration of FIGS. 1 and 2. FIG. 7C differs from the configuration of FIGS. 1 and 2 in that a coaster 10" depicted has elongate tethers 16' that are separate pieces from the main body of the coaster 10 and they are adhered to the coaster 10 using any fastening means understood by those of skill in the art to be appropriate (such as, for example, adhesive). FIG. 7D is again similar to the configuration of FIGS. 1 and 2, but the coaster 10''' differs in that elongate tethers 16" depicted are substantially shorter relative to the height of the plurality of tabs 20 and the diameter of the coaster 10''' (again relative to the length of the elongate tethers 16 versus the diameter of the coaster 10 of the other embodiments). FIG. 7E depicts a coaster 10'''' with only two elongate tethers 16''' formed by a single separate component coupled to the main body of the coaster 10. It should be noted that the difference between the length of the elongate tethers 16 and the height of each of the plurality of tabs is a primary differentiating factor in identifying a tether versus a tab. Furthermore, it is possible to increase the number of elongate tethers 16 to be greater than the number of tabs forming the plurality of tabs 20 and still fall within the scope of the present invention; however, it should be further noted that having such a large quantity of tethers 16 versus tabs 20 only serves to increase the amount of material required to manufacture the coaster 10, and therefore is not preferable over the configurations depicted and described herein that make use of only a few elongate tethers 16 to accomplish the required functionality of the invention. Furthermore, all variations of configurations for the coaster 10 (including coaster 10', 10", 10''' and 10'''') depicted and described herein are considered to fall within the general scope of the present invention, with the understanding that some configurations will perform better than others depending on the particular cup sleeve 24 and/or cylindrical or frusto-conical cup 28 utilized in conjunction with the coaster 10 to perform as described herein, such that all such) configurations, and equivalents thereof, are considered to fall within the scope of the present invention, and the present invention is by no means limited to the configurations shown.

FIGS. 8A, 8B, and 8C depict the coaster 10 in three different configurations varying the length of the elongate tethers 16. The purpose of these figures is to demonstrate that the coaster 10 of the present invention can vary in terms of length of elongate tether 16, relative to the base 12, in accordance with what one of skill in the art selected the elongate tether 10 length would appreciate based on the teachings of the present disclosure. The elongate tethers 16 must be sufficiently long to operate as described herein with respect to frictionally drag against the cup sleeve 24 and stabilize the base 12 of the coaster 10 such that it doesn't flip as the coaster 10 is pushed through toward a bottom opening of the cup sleeve 24 by the base of the generally cylindrical or frusto-conical cup 28 as it is placed through the cross-sectional opening 26 of the cup sleeve 24. The elongate tethers 16 must also frictionally hold the coaster 10 in place when in the final combination with the cup sleeve 24 and the cylindrical or frusto-conical cup 28, such as depicted in FIG. 4C. FIG. 8A shows the elongate tethers 16" in a short configuration, such as also shown in the coaster 10''' of FIG. 7D. The elongate tethers 16 of the coaster 10 in FIG. 8C are most similar in relative dimension to the embodiments of the coaster 10 depicted in FIGS. 1 and 2, et al. FIG. 8B is representative of a coaster 10'''' having elongate tethers 16'''' having a relative dimension to the base of the coaster 10'''' that is lengthwise in-between that of FIGS. 8A and 8C. In example experimental implementations, the inventor has found that between about 0.5 inches (about 1.27 centimeters) and 1.5 inches (3.81 centimeters) is a preferred range of length for the elongate tether 16. A shorter length than 0.5 inches (1.27 centimeters) reduces the effectiveness of the elongate tether 16 to stabilize the base 12 of the coaster 10, and also the effectiveness of the elongate tether 16 to frictionally hold the coaster 10 in place. A length longer than 1.5 inches (3.81 centimeters) maintains the effectiveness of the elongate tethers 16 to both stabilize and frictionally hold the coaster; however, lengths of beyond about 2 inches (about 5.08 centimeters) provide no additional stabilization or hold beyond what is required for operation, and begin to extend beyond the cup sleeve 24 and become unsightly and impractical. The maximum length of the elongate tethers 16 when being configured for use with a specific cup sleeve 24 can be limited to the height of the cup sleeve 24, such that the elongate tethers 16 do not extend beyond the cup sleeve 24 when in final combination therewith, as would be readily understood by those of skill in the art based on the teachings of the present description.

In accordance with an example embodiment of the present invention, the moisture absorbent coaster 10 includes the base 12 formed of at least partially absorbent material as described above herein. The two or more elongate tethers 16 extend from the base 12 and are positionable in a generally orthogonal direction relative to the generally planar base 12. The plurality of tabs 20 can be disposed along the outer perimeter 14 of the generally planar base 12, each of the plurality of tabs 20 positionable in a generally orthogonal direction relative to the generally planar base 12. The outer perimeter 14 of the generally planar base 12, not including the two or more elongate tethers 16, is of a generally geometric shape, and the two or more elongate tethers 16 extend beyond and external to that generally geometric shaped outer perimeter 14. The generally geometric shape approximates a circular shape as described and depicted herein, but is not required to be mathematically precise. The coaster 10 is sized, dimensioned, and configured to be pushed through a cross-sectional area of the cup sleeve 24 configured to frictionally fit around a beverage container such as the cylindrical or frusto-conical cup 28, the coaster 10 pushed through by the beverage container being pushed by a user. Upon the coaster 10 being pushed through the cross-sectional area of the cup sleeve 24 (such as is illustrated in sequence from FIG. 3 to FIGS. 4A, 4B, and 4C), the plurality of tabs 20 fold in the generally orthogonal direction to the generally planar base 12 and the two or more elongate tethers 16 fold in the generally orthogonal direction to the planar base 12, in such a way that the plurality of tabs 20 form the raised edge 18 (in the form of the annular wall 22) along the outer perimeter 14 of the base 12.

In operational use, as depicted in the flowchart of FIG. 4D, as well as FIGS. 3, 4A, 4B, and 4C, a user holds the cup sleeve 24 opened into a generally circular cross-sectional configuration and the coaster 10 with the two or more elongate tethers 16 and the plurality of tabs 20 initially in a combination-ready configuration (e.g., bent, positioned, or oriented toward the orthogonal direction from the base 12) (step 100). The user places the coaster 10 as shown into the generally circular cross-sectional opening 26 of the cup sleeve 24 (step 102) to arrive at the configuration depicted in FIG. 4A. The user then places the cylindrical or frusto-conical cup 28 on top of the coaster 10 (step 104) as depicted in FIG. 4B, and pushes the cylindrical or frusto-conical cup 28 and the coaster 10 down through the cup sleeve 24 until a maximum distance of the base 12 of the coaster 10 being stopped by the table or surface upon which the cup sleeve 24 rests (step 106) as depicted in FIG. 4C. Those of skill in the art will appreciate that depending on the particular dimensions of the specific coaster 10, cup sleeve 24, and cylindrical or frusto-conical cup 28, the cylindrical or frusto-conical cup 28 and coaster 10 may not be able to be pushed completely down to the table or surface, if for example, the friction fit is too snug and the cylindrical or frusto-conical cup 28 is prevented from being further pushed without fracturing, tearing, or otherwise destroying the cup sleeve 24. However, even in an arrangement of the cylindrical or frusto-conical cup 28 and coaster 10 being pushed partially, but not completed to the table surface, the coaster 10 of the present invention still operates to absorb condensation, and to robustly hold the combination of the coaster 10 and cup sleeve 24 onto the cylindrical or frusto-conical cup 28 in accordance with the present invention. Furthermore, the cup sleeve 24 can in such arrangement serve as the new base of the cylindrical or frusto-conical cup 28 for the cylindrical or frusto-conical cup 28 to rest upon, such that the present invention anticipates and encompasses such an arrangement or configuration as well. Said differently, it is not imperative that the coaster 10 be capable of being pushed through the cup sleeve 24 until the exterior surface 34 of the coaster 10 is exactly in line with the bottom edge of the cup sleeve 24 and is resting on the table or surface upon which the entire combination is placed in order for the combination to be functional in achieving is desired objectives as described herein in terms of absorbing condensation and being frictionally held onto the cylindrical or frusto-conical cup 28 robustly.

The phrase "generally circular cross-sectional opening" is utilized herein to describe the opening of the cup sleeve 24 when in a fully expanded configuration. The relative term "generally" in this context is intended to indicate that the opening need not be a mathematically perfect circle. Rather, when one expands a cup sleeve 24, the cup sleeve 24 progresses from a flat folded construct, to an eye shape, and eventually toward a circular shape. The fully expanded configuration need only approach a circular shape as would be understood by those of skill in the art, to receive the coaster 10 of the present invention. The act of receiving the coaster 10 will further expand the cup sleeve 24 toward the circular fully expanded configuration. As such, the cup sleeve 24 need not be completely expanded into a mathematically perfect circle. Rather, the "generally circular" opening is sufficient for receiving the coaster 10 of the present invention in the manner described. This description, together with the accompanying figures, provides reasonable clarity to one of skill in the art as to the scope of the phrase generally circular cross-sectional opening.

The term "generally" as utilized herein is intended to mean approaching and including, but not necessarily requiring, mathematical perfection or exactness. Anything described herein as "generally" being something is intended to indicate the thing is sufficiently close to mathematical perfection or exactness as to be recognizable by one of skill in the art as being that thing, and/or to be sufficiently close to that mathematical perfection or exactness as to be functional and operable commensurate with a similar thing but of mathematical perfection for the intended purpose of that thing, and/or refers to being in the nature of or sufficiently functionally equivalent to for the purpose or operation described, so as to be readily appreciated by those of ordinary skill in the art, or skill in the art. For example, a conventional beverage cup is readily recognized as having a generally circular base and cross-sectional shape, but mathematical perfection of such circular shape is not required and is likely not achieved in most instances. Further likewise, a conventional cup sleeve typically has two folds and when expended to fit around a cup takes on a generally circular shape (to match that of the cup). However, the two folds will remain as creases and will prevent the cup sleeve from taking on a circular shape to mathematical perfection in most typical uses. Yet the cup sleeve will be considered in the context of the present invention to be in a generally circular cross-sectional shape.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may existing in the upper and lower limits of the ranges of subjective or objective values, such as variations in properties, parameters, sizes, and dimensions. In one non-limiting example, the terms "about" and "approximately" mean at, or plus 10 percent or less, or minus 10 percent or less. In one non-limiting example, the terms "about" and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A coaster for use in combination with a cup sleeve, the coaster comprising:

a generally disk shaped base having an outer perimeter; and two or more elongate tethers extending outwardly from the outer perimeter of the base;

wherein the coaster assumes a combination-ready configuration with a raised edge folded from the outer perimeter of the base and along an entirety of the perimeter between the two or more elongate tethers, a length dimension of the two or more elongate tethers being at least twice a height dimension of the raised edge and less than about 2 inches; and wherein the combination-ready configuration further comprises the two or more elongate tethers arranged in an angled configuration relative to the base, each of the two or more elongate tethers extending generally upright and outwardly to a same side of the base.

2. The coaster according to claim 1, the raised edge comprising a plurality of tabs angled upright from the base along the outer perimeter to form the raised edge.

3. The coaster according to claim 1, the raised edge comprising an annular wall extending upright from the base along the outer perimeter to form the raised edge.

4. The coaster according to claim 1, wherein in the combination-ready configuration the base and the two or more elongate tethers have a structure sized, dimensioned, and configured to snugly fit and frictionally mount within the cup sleeve when the base is oriented generally planar with a generally circular cross-sectional opening of the cup sleeve when in a fully expanded configuration and the opening of the cup sleeve is expanded to receive a generally cylindrical or frusto-conical cup therethrough.

5. The coaster according to claim 4, wherein the base of the coaster is configured to receive a base of the generally cylindrical or frusto-conical cup as it is placed through the cross-sectional opening of the cup sleeve.

6. The coaster according to claim 4, wherein the structure of the two or more elongate tethers is sized, dimensioned, and configured to frictionally drag against the cup sleeve and stabilize the base of the coaster as the coaster is pushed through toward a bottom open end of the cup sleeve by the base of the generally cylindrical or frusto-conical cup as it is placed through the cross-sectional opening of the cup sleeve.

7. The coaster according to claim 1, wherein the coaster is in a final combination configuration with the cup sleeve when the coaster occupies and is oriented generally planar with a generally circular cross-sectional opening of the cup sleeve when the cup sleeve is in a fully expanded configuration, in such a way that the opening of the cup sleeve is configured to receive a generally cylindrical or frusto-conical cup therethrough.

8. The coaster according to claim 1, wherein the structure of the two or more elongate tethers is sized, dimensioned, and configured having a thickness dimension enabling compression of the two or more elongate tethers between the cup sleeve and a generally cylindrical or frusto-conical cup placed therein, the two or more elongate tethers frictionally holding the base in place to cover an open end of the cup sleeve.

9. The coaster according to claim 1, wherein the coaster is comprised of a moisture absorbent material.

10. The coaster according to claim 1, wherein the coaster is comprised of a material that is biodegradable, compostable, or both.

11. The coaster according to claim 1, further comprising a water-impermeable coating material disposed to form a layer on an exterior side of the base.

12. The coaster according to claim 11, wherein the water-impermeable coating material is biodegradable.

13. The coaster according to claim 1, wherein the coaster is biodegradable and recyclable.

14. The coaster according to claim 1, further comprising indicia disposed thereon.

15. The coaster according to claim 1, comprising three elongate tethers.

16. The coaster according to claim 1, comprising four elongate tethers.

17. A moisture absorbent coaster, comprising:

a generally disk shaped body including a generally planar surface, and further comprising at least one layer of at least partially absorbent material;

two or more elongate tethers extending from the body and positionable in a generally orthogonal direction in relation to the generally planar surface of the body;

wherein the coaster assumes a combination-ready configuration with a raised edge folded from an outer perimeter of the body and along an entirety of the perimeter between the two or more elongate tethers, a length dimension of the two or more elongate tethers being at least twice a height dimension of the raised edge and less than about 2 inches;

wherein the body has a structure sized, dimensioned, and configured to be pushed by a beverage container through a cross-sectional area of a sleeve that is configured to frictionally fit around the beverage container;

wherein when the body is pushed through the cross-sectional area of the sleeve, the two or more elongate tethers fold generally orthogonal to the body and are frictionally wedged between the beverage container and the sleeve frictionally holding the coaster in place coupled with the beverage container and the sleeve.

18. The coaster of claim 17, further comprising a plurality of tabs disposed along the outer perimeter of the body, each of the plurality of tabs positionable generally orthogonal relative to the generally planar surface of the body.

19. The coaster of claim 18, wherein the plurality of tabs fold generally orthogonal to the disk shaped base of body in such a way that the plurality of tabs form the raised edge along the outer perimeter of the body when the coaster is combined with the sleeve.

* * * * *